US005690282A

United States Patent [19]

Guo

[11] Patent Number: 5,690,282

[45] Date of Patent: Nov. 25, 1997

[54] SPRAY NOZZLE DEVICE

[76] Inventor: Wen-Li Guo, No. 10, Fang Dong Road,, Wen Gin Tsuen, Fang Yuan Hsiang, Chang Hua Hsien, Taiwan

[21] Appl. No.: 630,341

[22] Filed: Apr. 10, 1996

[51] Int. Cl.[6] ..... B05B 1/00

[52] U.S. Cl. ..... 239/395; 239/446

[58] Field of Search ..... 239/390, 391, 239/392, 393, 395, 436, 443, 444, 446, 530, 548, 561

[56] References Cited

U.S. PATENT DOCUMENTS

| | | | |
|---|---|---|---|
| 586,955 | 7/1897 | Askins | 239/446 |
| 924,867 | 6/1909 | Winfield et al. | 239/446 |
| 2,609,240 | 9/1952 | Faulkner et al. | 239/391 |
| 3,392,920 | 7/1968 | Gagliardo | 239/446 |

*Primary Examiner*—Andres Kashnikow
*Assistant Examiner*—Steven J. Ganey
*Attorney, Agent, or Firm*—Charles E. Baxley, Esq.

[57] ABSTRACT

A spray nozzle includes a casing having a middle and a side passages formed in the curved front. A valve is rotatably supported in the casing and has an upper and a lower notches for aligning with the passages. A housing is rotatably secured to the casing and has two or more channels for selectively aligning with the middle passage and has one passageway for communicating with the side passage. The valve may be rotated so as to selectively align the upper and the lower notches with the side and the middle passages.

6 Claims, 2 Drawing Sheets

SPRAY NOZZLE DEVICE

BACKGROUND OF THE INVENTION

1. Field of the Invention

The present invention relates to a nozzle, and more particularly to a multiple pattern spray nozzle.

2. Description of the Prior Art

Typical spray nozzles comprise a control barrel rotatably secured to a head and having a number of outlets selectively engaged with a water passage of the head so as to form different spray water outlet patterns. One type of the spray nozzles is disclosed in U.S. Pat. No. 4,666,085 to Liaw. However, it will be difficult to accurately align either of the outlets with the water passage of the head.

The present, invention has arisen to mitigate and/or obviate the afore-described disadvantages of the conventional water spray nozzles.

SUMMARY OF THE INVENTION

The primary objective of the present invention is to provide a spray nozzle having a configuration for effectively controlling the water outlets.

In accordance with one aspect of the invention, there is provided a spray nozzle comprising a casing including a chamber formed therein and including an inlet for connecting the chamber to a water reservoir, the casing including a curved front portion having at least one first passage and a second passage formed therein and communicating with the chamber, a block rotatably supported in the casing, a valve secured to the block and including at least one first notch formed therein for aligning with the first passage and including a second notch for aligning with the second passage, a housing rotatably secured to the casing at a pivot shaft and including at least two channels formed therein for selectively aligning with the second passage and including at least one passageway formed therein for communicating with the first passage, a head secured to the housing and including a plurality of holes formed therein for aligning with the passageway and including at least two outlets formed therein for aligning with the channels respectively, and means for rotating the block so as to selectively align the first and the second notches with the first and the second passages respectively.

The housing includes a curved wall formed therein and includes a plurality of partitions formed therein so as to form the channels and the passageway therein, the curved wall includes at least two punctures communicating with the channels respectively, the housing further includes a curved pad secured to the curved wall, the curved pad includes a groove for aligning with the first passage and includes at least two openings formed therein for aligning with the first passage and the punctures.

The housing further includes a lid secured to the partitions so as to enclose the channels and so as to form a gap between the lid and the housing, the gap is communicating with the passageway and communicating with the groove of the curved pad.

The casing includes a pair of apertures formed therein, the block includes a pair of studs rotatably engaged in the apertures so as to be rotated relative to the casing about the studs, at least one of the studs includes an engaging hole formed therein, the rotating means includes a knob having a protrusion extended therefrom and engaging with the engaging hole so as to rotate the block and the valve.

The valve includes a flat surface formed therein for aligning with the first and the second passages so as to block the first and the second passages.

The head includes a peripheral portion, the holes are formed in the peripheral portion, the head includes a middle portion having a cavity formed therein, the head further includes a board, the outlets are formed in the board and engaged with the cavity, the board includes at least one orifice for aligning with the passageway and for communicating with the holes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
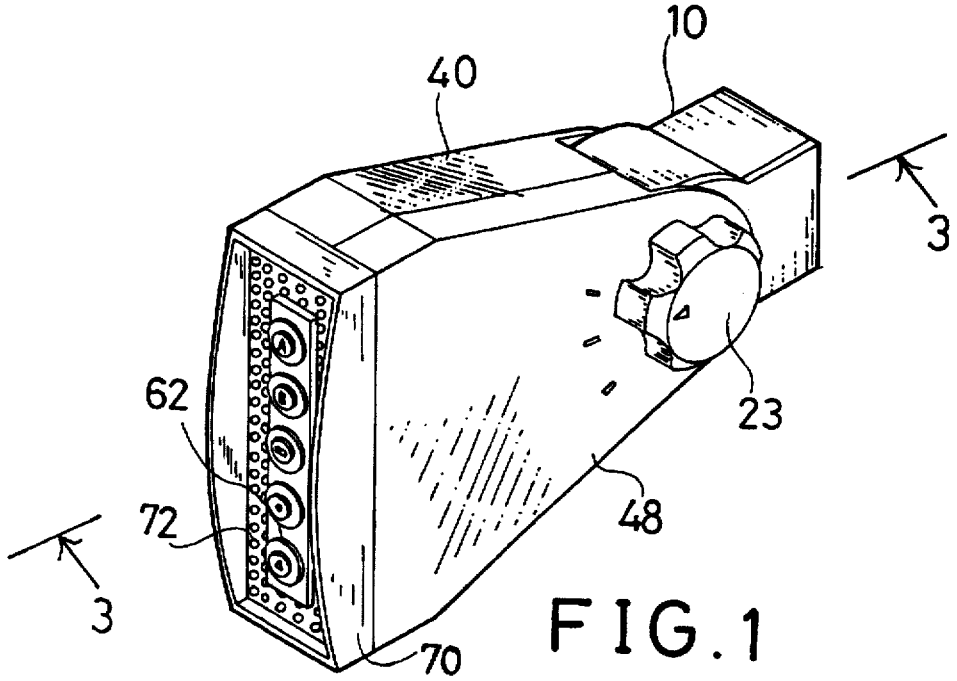
FIG. 1 is a perspective view of a spray nozzle in accordance with the present invention.

Referring to the drawings, a spray nozzle device in accordance with the present invention comprises a casing 10 having a chamber 11 formed therein and having an inlet 12 for connecting the chamber 11 to a water reservoir. The casing 10 includes a cap 16 secured to one side portion thereof and includes a pair of pivot shafts 17, 18 each having an aperture 171, 118 formed therein. The casing 10 includes a curved front portion 15 having one side passage 14 and a middle passage 13 formed therein and communicating with the chamber 11. A block 20 includes a pair of studs 201 extended therefrom and rotatably engaged in the apertures 171, 181 of the casing 10 such that the block 20 is rotatable about the studs 201. The block 20 includes a recess 21 formed therein. A valve 30 includes a rear portion secured in the recess 21 of the block 20 and includes a notch 31 formed in the upper portion for aligning with the side passage 14, and includes another notch 32 formed in the lower portion for aligning with the middle passage 13, and includes a flat middle portion 33 for blocking the passages 13, 14. One of the studs 201 includes an engaging hole 22 formed therein for engaging with a protrusion 24 of a knob 23 so as to be rotated by the knob 23.

A pair of plates 40, 48 may be secured together so as to form a housing. The plates 40, 48 each includes an orifice 80, 81 formed in the rear portion for rotatably engaging with the pivot shafts 17, 18 of the casing 10. The plate 40 includes a curved wall 47 and a number of partitions 41 formed therein so as to form five channels 42 and two passageways 45, 46 therein. The curved wall 47 includes five punctures 43 formed therein and communicating with the channels 42 respectively. A lid 44 is secured to the partitions 41 so as to enclose the channels 42 and so as to form a gap between the lid 44 and the plate 48. The gap is communicating with the passageways 45, 46. A curved pad 50 is secured to the curved wall 47 and includes a groove 52 for aligning with the side passage 14 and the gap between the lid 44 and the plate 48, and includes five openings 51 formed therein for aligning with the middle passage 13 and the punctures 43.

A head 70 includes a number of holes 72 formed in the peripheral portion thereof and includes a middle portion having a cavity 71 formed therein. A board 60 is secured to the head 70 and includes five outlets 62 for engaging with the cavity 71 and for aligning with the channels 42 respectively, and includes a pair of orifices 63, 64 for aligning with the passageways 45, 46 and for communicating with the holes 72. The outlets 62 each includes a different outlet pattern. The head 70 may be secured to the plates 40, 48 and the plates 40, 48 may be secured together by ultrasonic welding processes.

Figure 3:
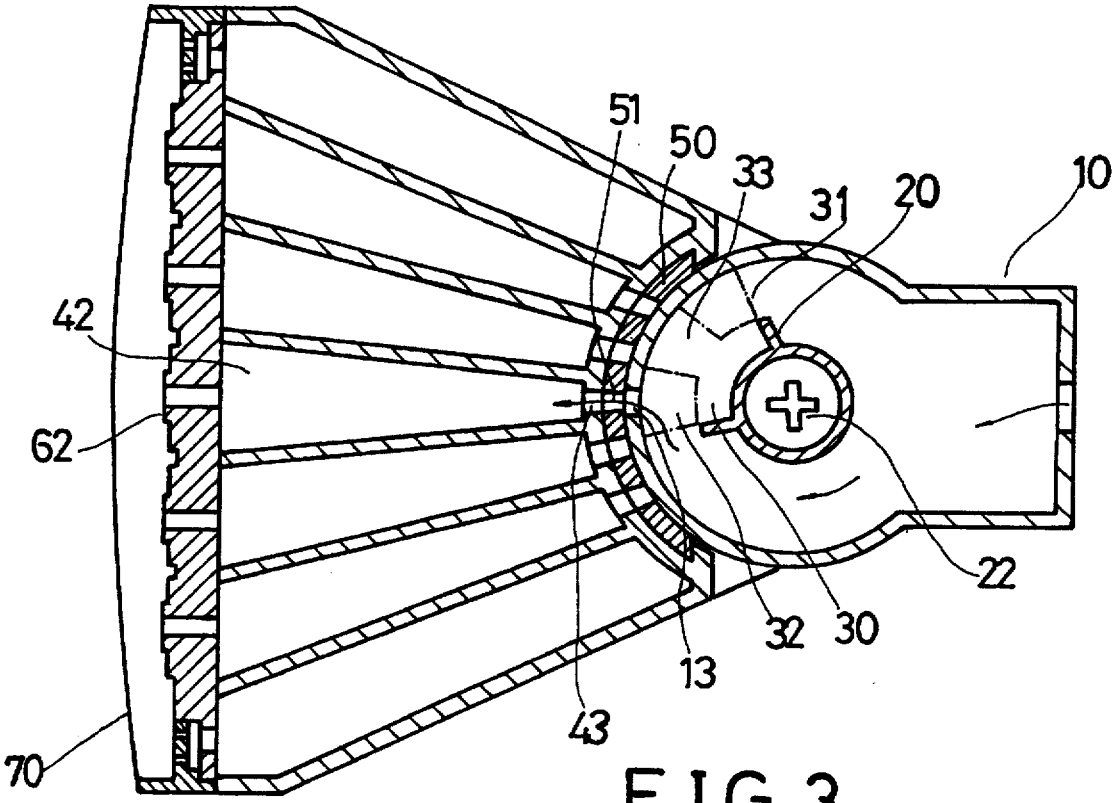
FIG. 3 is a cross sectional view illustrating the operation of the spray nozzle.
Figure 2:
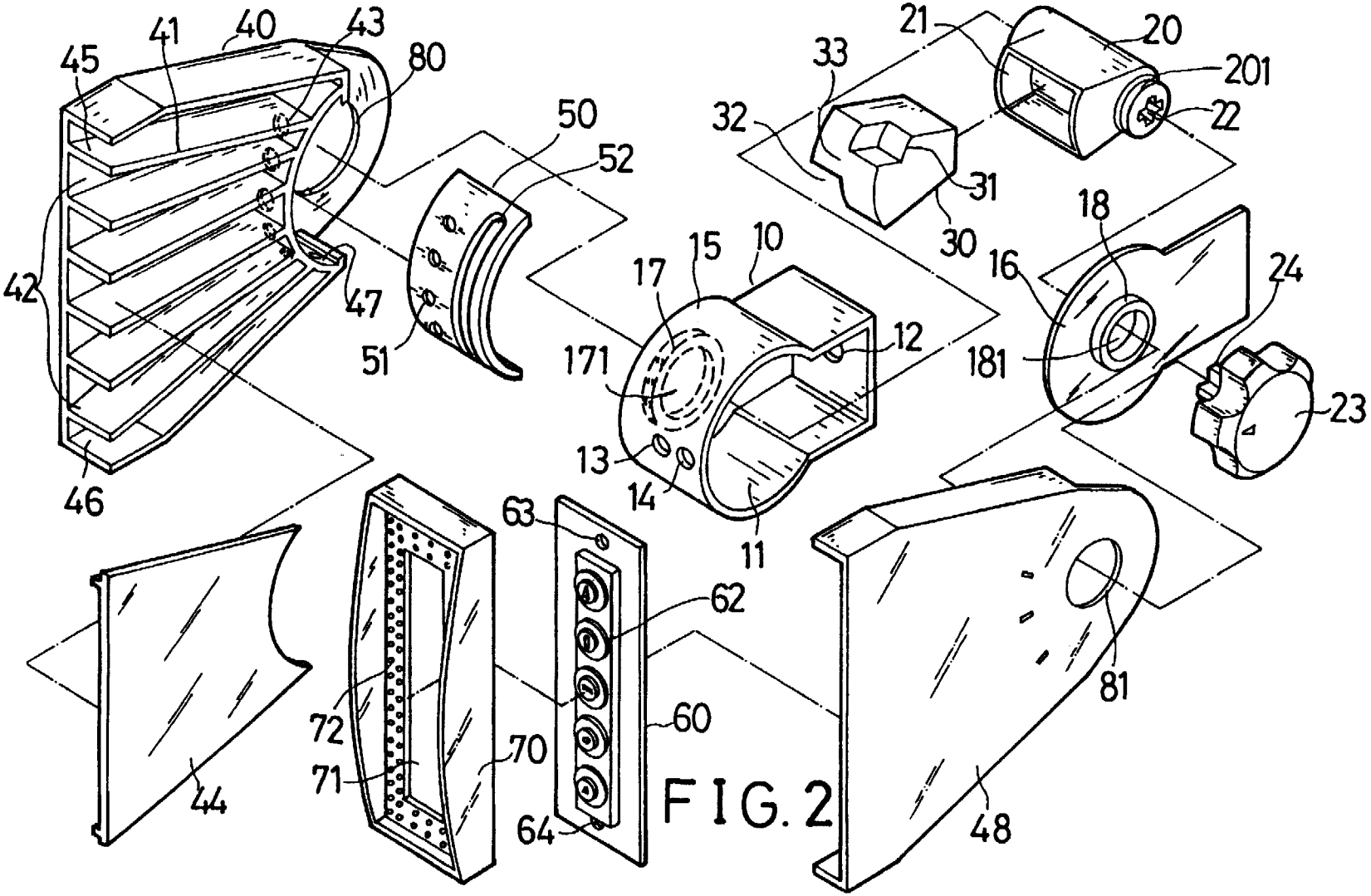
FIG. 2 is an exploded view of the spray nozzle.

In operation, as shown in FIGS. 2 and 3, when the block 20 and the valve 30 are rotated by the knob 23, the notch 31 may be aligned with the side passage 14 such that the water contained in the chamber 11 may flow through the notch 31 and the passage 14 and may flow out of the spray nozzle via the groove 52 and the gap formed between the lid 44 and the plate 48 and the passageways 45, 46 and the holes 72. As shown in FIG. 3, when the valve 30 is rotated to align the notch 32 with the middle passage 13, water is allowed to flow into the passage 13 and either of the openings 51 via the notch 32 and to flow out of the head 70 via either of the outlets 62. The passages 13, 14 may be blocked by the valve 30 when the middle portion 33 of the valve 30 is aligned with the passages 13, 14. The plates or the housing 40, 48 may be rotated about the pivot shafts 17, 18 so as to align either of the openings 51 with the middle passage 13. The plate 40 may include one bulge for engaging five depressions (not shown) of the hub 17 so as to position the housing 40, 48 relative to the casing 10 and so as to align the middle passage 13 with either of the openings 51.

Accordingly, the spray nozzle in accordance with the present invention includes a configuration that may be effectively controlled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spray nozzle comprising:

a casing including a chamber formed therein and including an inlet for connecting said chamber to a water reservoir, said casing including a curved front portion having at least one first passage and a second passage formed therein and communicating with said chamber, a block rotatably supported in said casing, a valve secured to said block and including at least one first notch formed therein for aligning with said first passage and including a second notch for aligning with said second passage, a housing rotatably secured to said casing at a pivot shaft and including at least two channels formed therein for selectively aligning with said second passage and including at least one passageway formed therein for communicating with said first passage, a head secured to said housing and including a plurality of holes formed therein for aligning with said passageway and including at least two outlets formed therein for aligning with said channels respectively, and means for rotating said block so as to selectively align said first and said second notches with said first and said second passages respectively.

2. A spray nozzle according to claim 1, wherein said housing includes a curved wall formed therein and includes a plurality of partitions formed therein so as to form said channels and said passageway therein, said curved wall includes at least two punctures communicating with the channels respectively, said housing further includes a curved pad secured to said curved wall, said curved pad includes a groove for aligning with said first passage and includes at least two openings formed therein for aligning with said first passage and said punctures.

3. A spray nozzle according to claim 2, wherein said housing further includes a lid secured to said partitions so as to enclose said channels and so as to form a gap between said lid and said housing, said gap is communicating with said passageway and communicating with said groove of said curved pad.

4. A spray nozzle according to claim 1, wherein said casing includes a pair of apertures formed therein, said block includes a pair of studs rotatably engaged in said apertures so as to be rotated relative to said casing about said studs, at least one of said studs includes an engaging hole formed therein, said rotating means includes a knob having a protrusion extended therefrom and engaging with said engaging hole so as to rotate said block and said valve.

5. A spray nozzle according to claim 1, wherein said valve includes a flat surface formed therein for aligning with said first and said second passages so as to block said first and said second passages.

6. A spray nozzle according to claim 1, wherein said head includes a peripheral portion, said holes are formed in said peripheral portion, said head includes a middle portion having a cavity formed therein, said head further includes a board, said outlets are formed in said board and engaged with said cavity, said board includes at least one orifice for aligning with said passageway and for communicating with said holes.

* * * * *